United States Patent [19]

Leach

[11] 4,429,539

[45] Feb. 7, 1984

[54] HEAT EXCHANGERS FOR VUILLEUMIER CYCLE HEAT PUMPS

[75] Inventor: James W. Leach, Raleigh, N.C.

[73] Assignee: Vought Corporation, Dallas, Tex.

[21] Appl. No.: 433,316

[22] Filed: Oct. 7, 1982

[51] Int. Cl.[3] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 2,900,798 | 8/1959 | Jonkers | 62/6 |
| 4,077,216 | 3/1978 | Cooke-Yarborough | 62/6 |
| 4,385,499 | 5/1983 | Lam | 62/6 |

*Primary Examiner*—Ronald C. Capossela
*Attorney, Agent, or Firm*—Thomas F. Daley

[57] ABSTRACT

The invention relates to a heat pump device comprising a pair of chambers and a plurality of elements extending within both chambers. A working fluid is disposed in both of the chambers and a displacer means is positioned in each of the chambers such that they are movable within their respective chambers. Both of the displacer means have a wall that divides their respective chambers into two zones, a regenerator material that is housed therein, a plurality of elements extending outwardly from and in proximity to the elements extending within the respective chamber, and at least one passageway communicating through each displacer means and through the respective regenerator material for the working fluid to flow therethrough between the zones. There is a drive means for reciprocably moving both of the displacer means in their respective chamber between the respective zones of the chamber. There is also means for maintaining one of the zones of each of the chambers at a cool temperature and means for maintaining the other of the zones either at a relatively hot temperature or at a cold temperature.

32 Claims, 9 Drawing Figures

HEAT EXCHANGERS FOR VUILLEUMIER CYCLE HEAT PUMPS

TECHNICAL FIELD

The present invention relates to heat exchangers and more particularly to heat exchangers used with a Vuilleumier Cycle operation and is applicable to heat pumps as well as refrigeration units.

BACKGROUND ART

The Vuilleumier Cycle was originally described by Rudolph Vuilleumier in U.S. Pat. No. 1,275,507 issued Aug. 13, 1918. In the patent he describes a method and apparatus for inducing heat changes using this particular cycle. The Vuilleumier cycle is capable of producing either a positive or a negative work upon expansion or contraction of a fluid under absolute pressure to secure secondary heating or cooling effects, respectively, in a second body of fluid that is in pressure interchanging relation therewith. A relatively cool fluid when brought into contact with a lower temperature fluid will raise the temperature of the latter fluid by primary heating and can also induce secondary heating in a fluid at another higher temperature. Conversely, a relatively warm fluid when brought into contact with a body of fluid at a higher temperature will lower the temperature of the latter fluid by primary cooling and can also induce secondary cooling in a fluid at a lower temperature. This secondary heating or cooling effect is produced by moving a portion of a fluid between several constant temperature and pressure zones and including the secondary effect in the remaining portion of the fluid. The apparatus generally comprises a pair of cylinders and a pair of piston-like displacer elements moving through adjacent halves of the two cylinders. However, the Vuilleumier Cycle apparatus differs from conventional heat pumps in that variations in the gas pressure are not produced by exerting an external force on a piston, but are caused by forcing the gas to flow back and forth between two ends of the fixed volume cylinder which ends are maintained at different constant temperatures to cause the pressure to change accordingly. The gas pressure variations which result from the displacer motion produce the desired heating or cooling effect.

The primary energy input to a Vuilleumier cycle unit is in the form of heat which is employed to elevate the temperature of one end of the cylinder. Referring to Vuilleumier's patented device, the gas or working fluid is forced to flow through the cylinders by means of a pair of reciprocating displacers or pistons 5 and 6 which are powered by a small drive means such as a small electric motor. As the displacers move back and forth in the cylinders, the air is forced to flow through heat regenerators 7, 8 in each of the displacers 5, 6, respectively, which comprises a central boring in the displacers having a large number of heat absorptive walls or elements. Since the pressure on opposing ends of the displacers 5, 6 is assumed to be essentially the same at any instant in time, the motor power required to move those displacers is small in comparison to the rate of heat input. As described in Vuilleumeir's patent a simple apparatus for employing the Vuilleumier cycle, shown in FIG. 2 of the Vuilleumier patent, includes a cylinder 4 having three distinct areas: a heated area at one end of cylinder 4 encompassed by a heating jacket 9, a centrally located cooling area cooled by jacket 15, and the refrigeration area cooled by jacket 12. Two pistons 5 and 6 are disposed to move between these areas for the purpose of effecting the heat exchange. For purposes of illustration the Vuilleumier cycle can be described as including 4 distinct phases. During phase 1, one of the pistons 5, which is disposed adjacent the heating jacket 9 moves outwardly towards the area encompassed by cooling jacket 15. As piston 5 moves, the air contained in cooling jacket 15 is displaced through regenerator 7 in piston 5 and directed into the now empty space encompassed by heating jacket 9. As the air moves through regenerator 7 it is subjected to a sudden increase in temperature. This primary heating of the air results in a secondary inductive heating of the air remaining in the cooling space when the heated air expands upon heating and a portion of it returns via regenerator 7 to the cooled area. The heating effect is drawn away by the cooling medium of jacket 15. During phase 2, the other piston 6, moves outwardly from the area encompassed by refrigeration jacket 12 into the remaining space that is cooled by cooling jacket 15 which maintains the cooled area at a constant temperature. During this movement the remaining air in cooled space 15 is displaced through the regenerator 8 in piston 6. Since the air embraced by the cooled space is assumed by Vuilleumier to initially be at the same temperature as that embraced by jacket 12, no change of temperature occurs and no secondary cooled effect is induced. During phase 3, piston 5 returns to its original position and the air is thereby returned from the heated space encompassed by jacket 9 through regenerator 7 to the cooling space encompassed by jacket 15 and arrives at the cooling space at a much higher temperature. As the air is moving through regenerator 7 it becomes cooler and this cooling causes a secondary cooling affect to take place throughout the cylinder due to a net reduction in pressure throughout the cylinder. This pressure reduction causes a slight flow of air from the refrigerating space encompassed by jacket 12, and as this air flows through regenerator 8 it is heated slightly partially cancelling out the secondary cooling effect. During the fourth phase, piston 6 returns to its original position and the remaining air in the refrigeration space is displaced through regenerator 8 to the cooling space and, as it passes through generator 8, it also absorbs a small amount of heat. This heating of the air as it moves through regenerator 8 causes a slight secondary heating to occur in the cylinder. The net effect, under normal working conditions, is that displaces 5 and 6 move air between different constant temperature areas and produce primary heat changes of equal but opposite value alternatively and also induce secondary heating and cooling effects. Heat absorbed from the heated space is imparted at a lower temperature to the cooling space, while heat drawn from the refrigerating space is imparted at a higher temperature to the cooling space. By applying a heat balance equation it can be shown that under the assumed temperature conditions for every BTU of heat transferred from the heated to the cooled space, two BTU's of heat will be transferred from the refrigerated space to the cooled space. This ratio can, as noted in the Vuilleumier patent, be increased or decreased by changing the temperatures and heat differentials.

This inherent characteristic of a Vuilleumier Cycle unit to use heat directly as an input power, makes it attractive for many uses. Vuilleumier cycle devices could easily be used with solar or waste heat powered heating and air conditioning systems. However, the currently available Vuilleumier Cycle units such as heat pumps have certain inherent disadvantages. For example, displacer cylinders of Vuilleumier cycle machines, for various applications, are necessarily larger than those of conventional compressors having the same capacity, and the operating pressure tends to be relatively high. Also, it is more difficult to transfer heat to the gas in the cylinders of a Vuilleumier Cycle Heat Pump, than to an evaporating liquid in the coils of a conventional refrigerator. This increases the cost of the Vuilleumier cycle unit. As a result, in recent years work has been geared toward identifying more efficient heat exchangers for use with the Vuilleumier Cycle units in order to reduce the size and complexity and the associated higher costs and to improve the efficiency of the heat exchange process.

For a Vuilleumier cycle unit to operate at its potential high efficiency it is necessary that the heat exchange be conducted with minimal temperature gradient from an external source to the working fluid in the cylinders. The conventional designs for such heat exchange call for enveloping the particular constant temperature area with means for maintaining that temperature and effecting the heat exchange through the walls of the cylinder. With larger sized cylinders for the larger capacity requirements, it becomes increasingly difficult to bring the working fluid into contact with the exterior walls of the cylinder of the Vuilleumier unit for a sufficient time to effect the proper heat exchange without causing undesirable pressure losses. In addition the larger the size of the particular cylinder, the more difficult it will become to uniformly effect the heat exchange with the result that there will be a temperature gradient through the working fluid generally corresponding to the size of the cylinder.

One approach to solving this difficulty is shown in Australian patent application No. 126969 published Apr. 2, 1947 in the name of the applicant N. V. Philips' Gloeilampenfaberieken, but withdrawn before being accepted for patent. The application disclosed improvements relating to refrigeration machines employing the reverse hot-gas motor principle (stirling cycle). The unit described therein, employed a series of complementary partitions 22, 23, 24 and 25 intended to make the expansion and compression of the gas more isothermal. However the means for heating, via inlet 18 and outlet 19, and cooling, refrigerating box 10, are still positioned to simply envelope their respective heated area 15 and cooled area 12.

Another approach is disclosed in U.S. Pat. No. 3,508,393 issued to D. A. Kelly on Apr. 28, 1970. Kelly discloses a chemical heating means for use with low friction Sterling Engines. The heating means comprises in addition to the conventional wraparound type a series of heating conduction rods placed within the hot side of the displacer volume. The rods are uniformly spaced and are intended to increase the heat transfer area and the rate of heat transfer.

None of the above-described systems adequately solves the problem of effecting a highly efficient, isothermal heat transfer, especially as relating to a Vuilleumier cycle unit. The heat transfer in all cases is highly dependent on the thermal conductivity of the materials of construction and nowhere is there disclosed a heating or cooling means that is virtually in intimate contact with the working fluid.

It is therefore an object of the present invention to provide a mechanism for achieving near isothermal heat transfer between the external fluid medium in the jackets of the Vuilleumier heat pump and the internal gas working fluid.

It is another object of the invention to provide a means for causing the external fluid to flow through finned passages that protrude into the working fluid area of the cylinder. It is another object to shape the displacer so that it's motion causes the internal gas to flow uniformly over the external surfaces of the finned passages.

It is another object to design the heat exchanger such that the gas is moving over the finned surface at the time that it expands or is compressed. The steady and uniform gas velocity provides forced convective heat transfer at the time needed for efficient operation of the heat pump.

It is another object to provide flow passages that are designed so that a minimum power input is required to cause the gas and external fluid to flow through the heat exchanger.

Finally it is an object to provide for external fluid passages that are machined into the cylinder head, and where the internal gas passages are integrated with the displacer regenerator such that the entire unit is easily manufactured and has minimum dead volume.

DISCLOSURE OF THE INVENTION

The invention provides for a heat pump comprising a pair of chambers and a plurality of elements extending within both chambers. A working fluid is disposed in the chambers and a displacer means is positioned in each of the chambers such that they are movable within their respective chambers. Both of the displacer means have a wall that divides their respective chambers into a first zone and a second zone, a regenerator material that is housed therein, a plurality of elements extending outwardly from and in proximity to the elements extending within the respective chamber, and at least one passageway communicating through each displacer means and through the respective regenerator material for the working fluid to flow therethrough between the zones. There is a drive means which is suitably supported for reciprocably moving both of the displacer means in their respective chamber between the respective zones of the chamber. There is also means for maintaining the first respective zone of each of the chambers at a cool temperature and means for maintaining the second respective zone of one of the chambers at a temperature that is higher than the temperature of the first respective zone and the second respective zone of the other chamber at a temperature that is lower than the temperature of the first respective zone.

BRIEF DESCRIPTION OF THE DRAWINGS

Further objects and advantages of the present invention will become apparent from the following description and claims, and from the accompanying drawings, wherein:

DETAILED DESCRIPTION OF THE INVENTION

Figure 1:
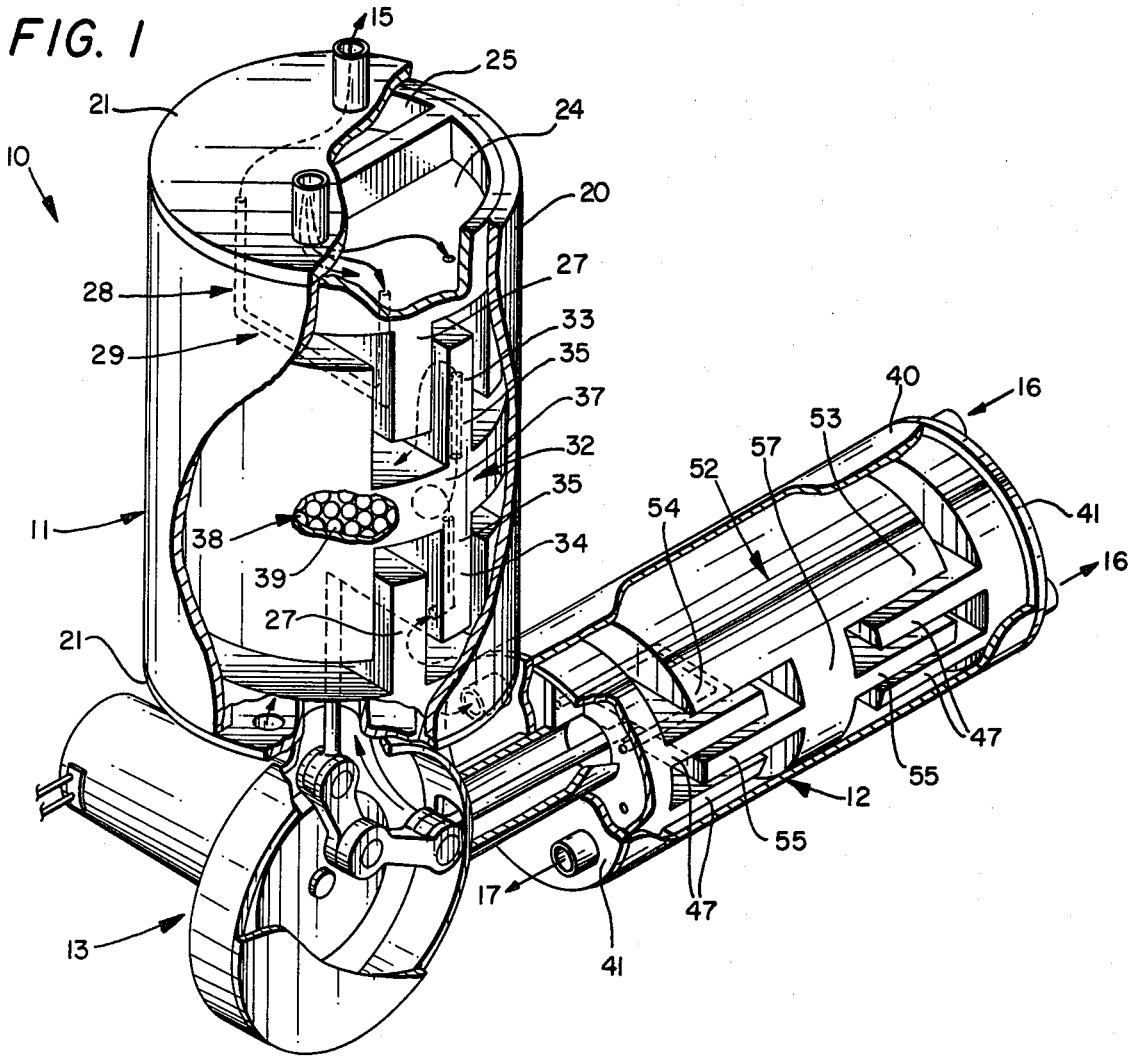
FIG. 1 is a perspective view of one embodiment of the present invention.

Referring now to the drawings in detail, wherein like numerals indicate like elements throughout the several views, the present invention is generally illustrated by the embodiment shown in FIG. 1. In FIG. 1 there is shown in perspective a refrigeration device 10. The device 10 comprises three sections; cold cylinder 11 positioned vertically in the view, hot cylinder 12 positioned horizontally, and drive section 13.

Figure 3:
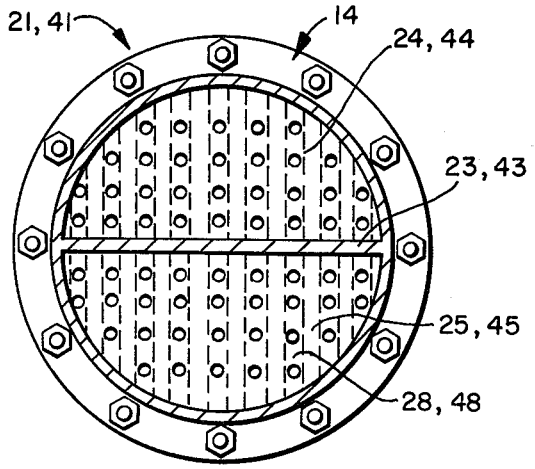
FIG. 3 is a bottom plan view of the end element of FIG. 2.
Figure 2:
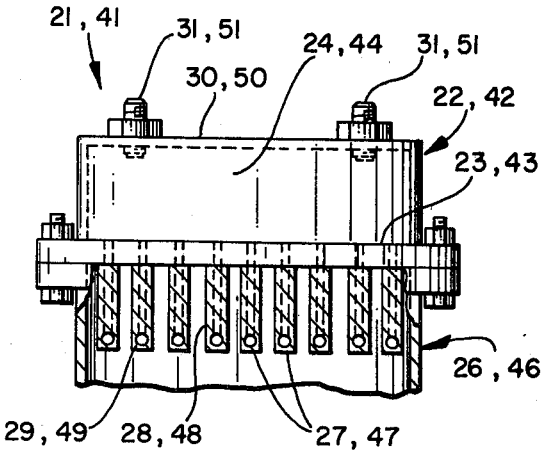
FIG. 2 is a side elevational view of a typical end element for use on both ends of the cylinders shown in the embodiment of FIG. 1.

The cylinders 11 and 12 are substantially similar in overall construction and both include a generally cylindrical outer wall, 20 and 40, respectively. Attached to the top and bottom of both cylinders 11 and 12 are cylindrical heads 21 and 41, respectively, shown in detail in FIGS. 2 & 3. Each head 21 and 41 comprises an upper section 22, 42 that is divided by wall 23, 43 into an inlet plenum 24, 44 and an outlet plenum 25, 45 and a lower section 26, 46 that comprises a plurality of downwardly extending fins 27, 47 that are generally perpendicular to the plane of the dividing wall 23, 43. Each fin 27, 47 has a plurality of vertical passageways 28, 48 communicating with the inlet plenum 24, 44 and the outlet plenum 25, 45 and horizontal passageways 29, 49 connecting the vertical passageways 28, 48. Suitable means are provided for attaching the head 21, 41 to the appropriate end, either top or bottom, of cylinder 11 or 12, such as the flange and bolt arrangement 14 shown in FIGS. 2 and 3. A cover insulator 30, 50 is provided over each plenum area to close off the plenum areas, and suitabel inlet/outlet ports 31, 51 are provided in the cover 30, 50 for connecting the several passageways to a source for the appropriate transport fluid 15 or 16.

Referring again to FIG. 1, between the top an bottom heads in each of cylinders 11 or 12 there is a displacer device 32, 52 that is generally cylindrical in shape and includes a top section 33, 53 and a bottom section 34, 54 composed of fin-like elements 35, 55 that are positioned such that they interfit between the plurality of fins 27, 47 on the top and bottom head 21, 41, respectively. Each fin 35, 55 may include a passageway 36, 56 (see FIG. 4) that communicates to an intermediate section 37, 57 of the displacer 32, 52 which is adapted to house a regenerator matrix 38, 58. The regenerator matrix 38, 58 in our embodiment of the invention comprises a plurality of regenerator elements 39, 59 nickel spheres that are primarily 0.003 inches in diameter and have a porosity of 39 percent. The size of the shot and the density may vary somewhat relative to the adjacent constant temperature zone.

The spherical design for the regenerator elements 39, 59 is prefered since it provides the maximum heat capacity and has a low porosity and consequently minimal dead volume. The small diameter of the multiplicity of spherical elements provides a large surface area for heat transfer to occur. Of course, other types of regenerator elements, such as screen wire meshes, could also be employed where the specific application differs.

The heating device 10 is designed to have three separate temperature zones. At the outwardly facing end of cylinder 11, the temperature is maintained at a cold or refrigerated level by a circulating refrigerant 15. At the outwardly facing end of cylinder 12, the temperature is maintained at a hot level by a circulating heated fluid 16. At the other end of both cylinders 11 and 12 adjacent to the drive section 13 the temperature is maintained at a relatively cool level by a third, externally conditioned, fluid 17. The three temperature zones could be maintained at their respective temperatures by other means than circulating fluids. For example the heated fluid associated with cylinder 12 could be substituted with waste heat from a mechanical drive or power plant.

Figure 6:
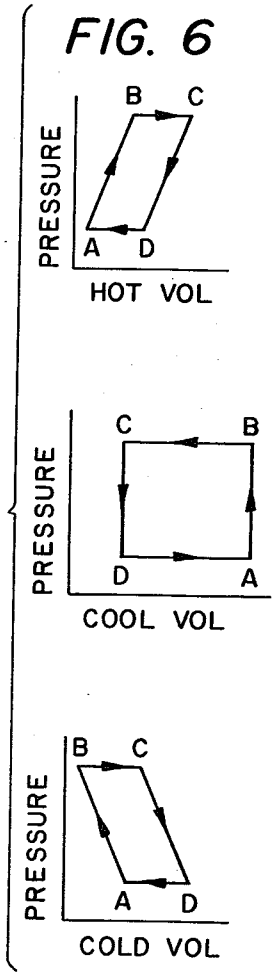
FIG. 6 presents graphical representations of the changes in the pressure and volume within the several temperature areas of the cylinder during the work cycle, i.e., from top to bottom, the hot volume area, the cooled volume area and the cold volume area.
Figures 5A, 5B, 5C, 5D:
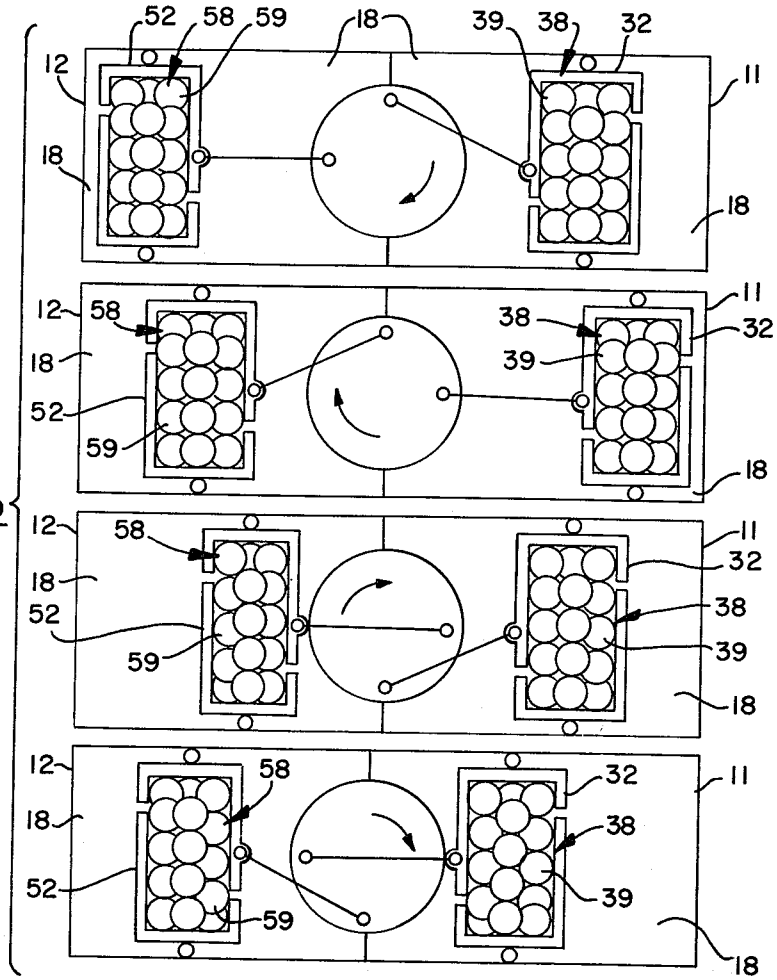
FIG. 5*a* is a schematic representation of one stage of the work cycle showing the heated cylinder displacer adjacent to the heated end element.
FIG. 5*b* is a schematic representation of the next stage of the work cycle after that shown in FIG. 5*a* on showing the refrigerated cylinder displacer adjacent the refrigerated end element.
FIG. 5*c* is a schematic representation of the next stage of the work cycle after that shown in FIG. 5*b* showing the heated cylinder displacer adjacent to the cooled end element.
FIG. 5*d* is a schematic representation of the next stage of the work cycle after that shown in FIG. 5*c* showing the refrigerated cylinder displacer adjacent to the cooled end element.

In operation, the heat device 10 proceeds through a periodic work cycle 19 as represented schematically by FIGS. 5*a–d* with resulting changes in temperatures and pressures as shown in FIG. 6. Having assumed that in the apparatus 10 the hot cylinder 12 has a certain specified temperature and that the cold cylinder 11 and the drive section 13 also have initial specified temperatures that are lower than that for the hot cylinder, we will further assume for the sake of simplicity in explaining the schematic FIGS. 5*a–d*, that the initial temperatures for the cold cylinder 11 is lower than that of the drive section 13. Also we will assume for the sake of simplicity that the volume of the air passages, i.e. the area of the regenerators not occupied by regenerator elements 39, 59, in each of the regenerators 38, 58 is small relative to the volume of free space available in the cylinders 11 and 12 to minimize the effect of the fluid 18 remaining in the regenerator relative to the temperature of the fluid 18 in the cylinder free space, and that the available heat capacity of each regenerator 38, 58 is many times the heat capacity of the working fluid 18 in the cylinders 11 and 12. The diagrams of FIGS. 5*a* through *d* show the successive positions of that the displacers 32, 52 occupy as they proceed through the work cycle 19. In the first position, shown in diagram 5*a*, the displacer 52, is positioned adjacent to cylinder 12 end wall and its working fluid 18 is positioned adjacent to the inward facing cool end of cylinder 12, and displacer 32 is shown as it begins to move towards the end wall of cylinder 11 and away from a position where displacer 52 was adjacent the cool end of cylinder 12. During this movement of displacer 32 FIG. 5*a* the working fluid 18 that had been in the space nearest to the refrigerated end of cylinder 11 is forced through regenerator 38 and out into the space adjacent to the cool end of cylinder 11. As the working fluid 18 moves through regenerator 38 it picks up heat from regenerator elements 39. Also, before displacer 32 completes its move towards the refrigerated end of cylinder 11, displacer 52 begins to move away from the heated end of cylinder 12, as shown in FIG. 5*b*, and, as it does, fluid 18, currently at the cool temperature end of cylinder 12 is drawn through regenerator 58 to the heated end of cylinder 12. The heat input to the working fluid 18 from the fins at the heated end of cylinder 12 causes the working fluid 18 to warm up to the initial specified temperature that is being maintained at that end of cylinder 12. This primary heating of fluid 15 eventually causes a secondary inductive heating of the entire fluid 18 when some of the heated fluid 18 expands back through regenerator 58 into the cooled area.

Both the flow from the cold end of cylinder 11 into the cooled end of cylinder 11 and the flow from the cooled end of cylinder 12 into the hot end of cylinder 12 cause temperature increases in the working fluid 18. Since the total volume occupied by the working fluid is fixed by the internal volume of the heat pump, the heating at constant volume increases the pressure of the working fluid 18. Thus the internal pressure at state B in FIG. 5 is higher than the pressure at state A in FIG. 5 . Because of the motion of the displacers the volume of the gas in the hot end of cylinder 12 increases during process A-B while the volume of the gas in the cold end of cylinder 11 decreases. The combined volumes of the gas in the cooled ends of cylinders 11 and 12 remains essentially constant. Thus when plotted on pressure-volume coordinates as in FIG. 6, the line representing process A-B slopes upwards to the right for the hog volume, upwards to the left for the cold volume, and vertically for the cool volume. In the next diagram 5*c*, displacer 52 completes its movement away from the heated end of cylinder 12 while displacer 32 is shown beginning its move away from the refrigerated end of cylinder 11.

In the intermediate process between state B of FIG. 5 and state C of FIG. 5 the working fluid is heated as it flows from the cool end to the hot end of cylinder 12, but is simultaneously cooled as it flows from the cool end to the cold end of cylinder 11. The net heat input is essentially zero so that the gas pressure remains constant as shown in process B-C of FIG. 6. Because of the motion of the displacers, the volumes of the gas in the hot end of cylinder 12 and in the cold end of cylinder 11 increase during process B-C. The combined volumes of the gas in the cooled ends of cylinders 11 and 12 decreases so that the total internal volume remains fixed. As displacer 32 moves farther away from the refrigerated end of cylinder 11 a portion of the working fluid 18 is pulled through regenerator 38. As fluid 15 moves through regenerator 38, elements 39 draw off some of the available heat from fluid 18 and fluid 18 arrives at the refrigerated end of cylinder 11 at very close to the maintained refrigeration temperature. The remaining portion of fluid 18 is displaced through regenerator 58 and into the cool end of cylinder 12 when displacer 52 moves away from the cooled end of cylinder 12.

The net cooling of the working fluid is in both cylinders during process C-D causes the pressure to fall as shown in FIG. 6. In the final diagram, 5*d*, displacer 32 has completed its move away from the refrigerated end of cylinder 11 and displacer 52 has begun its move back towards the heated end of cylinder 12. During this movement, working fluid 18 is returned from the heated space adjacent the heated end of cylinder 12 via regenerator 58 to the cooled space, imparting its heat to the regenerator elements 59, and therefore when it arrives at the cooled space it is already, cooled to substantially the cooled area temperature.

Also an additional portion of fluid 15 in the refrigerated end of cylinder 11 is forced through regenerator 38 into the cooled space. As this movement of fluid 18 occurs, fluid 18 absorbs a small amount of heat which eventually distributes throughout the cooled area working fluid.

The cooling of the working fluid 18 in regenerator 58 is off-set by the heating in regenerator 38 so that the pressure remains essentially constant in process D-A as shown in FIG. 6.

From thermodynamic analysis it may be shown that the heat input to the gas 18 within the hot volume of cylinder 12 for the cycle A-B-C-D-A is equal to the area enclosed within the clockwise proceeding path of the p-v diagram for the hot volume in FIG. 6. Also the net heat input per cycle to the gas 18 within the cold end of cylinder 11 is equal to the area enclosed within the clockwise proceeding path of the p-v diagram for the cold volume in FIG. 6. The heat rejected by the gas 18 at the cooled ends of cylinders 11 and 12 is equal to the area enclosed by the counterclockwise proceeding path of the p-v diagram of the cool volume of FIG. 6. Thus, the working fluid 18 absorbs heat in the hot volume and in the cold volume while rejecting heat in the cool volume. The net heat absorbed per cycle by the working fluid is equal to the net heat rejected so that the sum of the areas enclosed in the p-v diagrams for the hot and cold volumes is the same as the area enclosed by the diagrams for the cool volume.

Within the hot volume heat is transferred to the working fluid 18 from the heated external fluid 15 through the heat exchanger fins 27, 47. This heat transfer occurs during the part of the cycle when the gas 18 within the hot volume expands causing its temperature to fall below the temperatures of the surrounding metal surfaces 47, 55 and 27, 35. Similarly, within the cold volume heat is transferred from the gas 18 to the external coolant 17 through the fins 27, 47 attached to the inward facing cylinder heads. This heat transfer occurs during the part of the cycle when the gas within the cool volume is compressed causing its temperature to increase above the temperature of the surrounding metal surfaces.

The work cycle 19 is repeated continuously and the result will be substantially the same during each cycle. As the cycle repeats the temperature difference across the regenerators 38, 58 will eventually approximate the temperature differential between the two adjacent areas, i.e. for regenerator 38 the temperature at its extremes is the temperature of the refrigerated area and the temperature of the cooled area, and for regenerator 58 the gradient runs from the temperature at the cooled area to that of the heated area. Thermodynamically, this cycle provides for a refrigeration effect that is directly related to the temperatures maintained at the refrigerated and heated ends of the cylinders. It can be shown from basic principles that:

$$Q_r = \frac{[1 - T_c/T_h]}{[T_c/T_r - 1]} Q_h \quad (1)$$

where $Q_h$ is the heat transferred from the heated area to the working fluid 18; $T_h$ is the temperature at the heated end, $T_c$ is the temperature at the cooled end, $T_r$ is the temperature at the refrigerated end, and $Q_r$ is to heat transferred from the refrigerated area to the working fluid 18.

This equation is useful for determining the effect of the heat exchanger effectiveness on the overall performance of the heat pump. As a specific example, the effects of a temperature difference across the heat exchangers in the cool volume can be determined for the case when the device is used for air conditioning as follows. In such applications the coolant 17 at temperature T typically rejects heat to the atmosphere. The working fluid 18 within the cooled volume must be at a temperature in excess of T by an amount dT for heat to flow across the heat exchanger. Substituting into equation (1).

$$Q_r = \frac{[1 - T_{inf}/T - dT/T_h]}{[T_{inf}/T_r + dT/T_r - 1]} Q_h \quad \text{(1-a)}$$

or, $$Q_r = f(dT)\, Q_h \quad \text{(1-b)}$$

Since it is desirable to produce a large refrigeration effect Qr for a given heat input the multiplier f(dT) in Equation (1-b) should be large. However, for fixed values of $T_{inf}$, $T_r$ and $T_h$ the effect of dT is to reduce the numerator and increase the denominator of f(dT). Thus, it is obvious that temperature differences cross the cool volume heat exchanger are very detrimental to the performance of the heat pump in this case. Similar analyses show that the temperature differences in the hot volume and cold volume heat exchangers are also undesirable.

The important element, therefore, in effecting the Vuilleumier cycle is the ability to maintain the respective fixed temperature areas at temperatures that are as close as possible to those of the external fluids 15, 16, 17. In the past, the conventional method for maintaining temperature was primarily to select a highly conductive material for constructing the walls of the cylinders and then to heat or cool the cylinder walls as required to the desired temperatures. Next, in order to obtain the benefits of the working cycle 19, working fluid 18 had to be forced to travel against the heated or cooled cylinder walls during at least a portion of cycle 19 and for a sufficiently long period to effect the desired heat transfer to thereby change the temperature of fluid 18 to the proper temperature for the particular constant temperature area it was entering. The principal drawback to this method was that the heat transfer process is dependant upon the surface area of the cylinder walls where heat transfer occurs. With relatively small diameter cylinders this dependency posed little problem. However, since the surface area per unit of interior volume is inversely proportional to the diameter, the heat transfer area becomes inadequate in large cylinders.

To simplify the design of the cylinder unit, the means for maintaining the constant temperatures, i.e. the heater means or the refrigerator means, must be positioned and employed such that a maximum of surface area is available where the desired constant temperature of the several fixed temperature areas can be maintained, along the inside of the cylinders where the working fluid 18 can come into contact therewith. In addition the heat transfer surface area needs to be designed in such a way as to prevent any undue interference in the flow of working fluid from one fixed temperature area to another to thereby minimize pressure losses.

Consideration also needs to be given to the regenerators 38, 58 and to the housing area for the regenerator elements, 39, 59 in large diameter cylinders. A conventional design for Vuilleumier cycle device provides for housing the regenerator elements along the interior walls of the cylinders between the adjacent fixed temperature areas. Trying to force or direct the working fluid 15, 16 into an internal passageway along the interior wall of the cylinders to flow through a regenerator 38, 58 increases in difficulty with the increased diameter or size of the cylinder. In addition movement of the working fluid 15, 16 outwardly towards the interior walls of the cylinder may cause increased pressures at certain points in the cylinder, further reducing the efficiency of the unit.

To solve these problems, the present invention provides a series of protruding arms or fins 27, 47 located at both the top and bottom end of each cylinder 11, 12, respectively. For the most efficient heat transfer, these fins 27, 47 are preferably designed to accomodate a means for heating or cooling the individual fins as required to maintain the fins 27, 47 at the respective fixed temperature depending on the area into which they protrude. These fins 27, 47 can provide a much larger heat transfer surface area and thereby can also reduce the required volume of the Vuilleumier unit by improving the thermodynamic efficiency. In order to force the working fluid 18 to flow move uniformly across the fins 27, 47, the displacer devices 32, 52 are preferably designed to include cavities and corresponding fins 35, 55 that are complementary in size and shape to the outwardly extending fins 27, 47 of the cylinders 11, 12. The displacer fins 35, 55 are preferably designed to include cutouts or perforations to minimize pressure build ups at the ends of the fins. The mating fins i.e. the cylinder fins 27, 47 and displacer fins 35, 55 are then adapted for use as heat exchange surfaces and the stationary cylinder fins 27, 47 are maintained at the desired fixed temperature.

To maximize the effectiveness of these fins, working fluid 18 is preferably forced to travel through passageways in the displacer 32, 52 and not through the more conventional passageways commonly formed adjacent to the interior wall of the cylinders. The interior sections of the displacers 32, 52 are designed to house the regenerator elements 39, 59 and the regenerator matrix 38, 58 and each fin 35, 55 extending from the displacer 32, 52 is provided with a passageway 36, 56 that directs the incoming fluid 18 towards or away from the regenerator 38, 58. In order to reduce the number of flow passages in the displacer fins to reduce costs, and to control the flowrates through the individual gaps between the displacer and cylinder head fins, additional perforations 60 are provided on the cylinder head fins 27, 47. The cutouts 60 allow the working fluid 18 to relieve through the cutouts 60 and avoid any localized pressure increase. The present invention therefore provides that as the displacers 32, 52 transverse the length of their respective cylinders 11, 12 the working fluid 15, 16 is forced through the passageways 36, 56 in the fins 35, 55 at one end of the displacer 32, 52, through the regenerator 38, 58 housed in the displacer body and out of the passageways 36, 56 through the fins 35, 55 at the opposite end of the cylinder 11, 12.

The complementary design of the displacer fins 35, 55 and the cylinder fins 27, 47 allows one to design the Vuilleumier unit to control the movement of the working fluid 15, 16 completely and thereby to accomodate a wide variation in temperatures and applications for the Vuilleumier unit. Some of the more obvious variations include varying the number of fins both from the cylinder ends and from the displacer ends, varying the size and shape of the fins, varying the gaps between complementary fins on the displacer and the cylinder, or varying the size, shape and direction of the cut outs in the fins. Also the displacer passageways can be designed such that the flowrate of the working fluid through the regenerator is controlled. The passageways through the displacer fins can be designed such that the working fluid is directed perpendicularly against the cylinder fins upon exiting from the displacer fins and forced to flow in very thin layers (narrow gaps between the displacer fins and the cylinder fins) to maximize heat transfer along the external fixed temperature surfaces of the cylinder fins. The pre-sized gap between the cylinder fins and the displacer fins will dictate the thickness of the layer of working fluid. By designing the fins properly for a specific application, the working fluid can be brought into contact with the surface of cylinder fins and heat exchange can be effected immediately upon exiting from the displacer fins. By varying the size and shape of the fins and the gap between the fins, one can maximize the rate of convective heat transfer in a given application . Additional modifications can be made to the fins to control the speed of the working fluid as it exits from the displacer fin passageway and with respect to the flow rate of the working fluid along the external surfaces of the cylinder fins.

Figure 4:
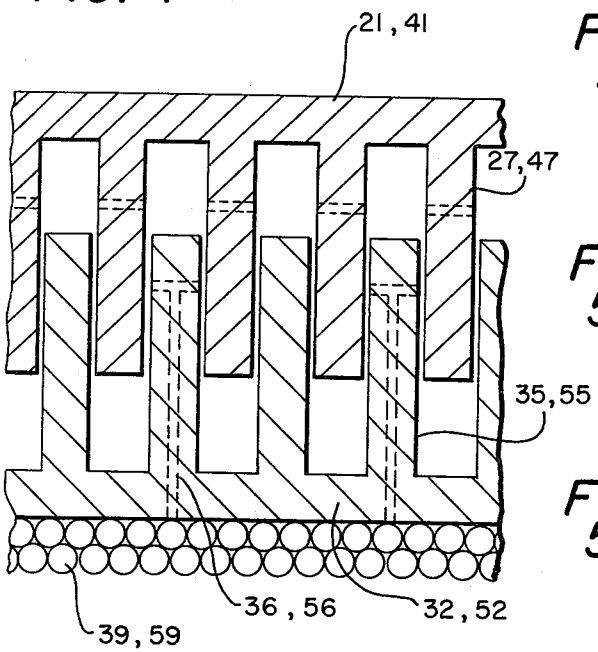
FIG. 4 is an enlarged, fragmentary, cross-sectional view of a typical end element installed on a cylinder and showing a portion of a displacer positioned adjacent to the end wall.

By way of example, one embodiment of a Vuilleumier cycle pump, shown in FIG. 4, includes some simple design variations intended to control the fluid 15, 16 and to optimize the heat transfer. FIG. 4 is an enlarged, cut away view showing a complementary set of cylinder fins 27, 47 and displacer fins 35, 55. The displacer fins 35, 55 are provided with a working fluid passageway 36, 56 that extends longitudinally along the length of the fins and ends in T-shaped exit passageway. The exit passageway is designed to direct the working fluid into the gaps between the adjacent cylinder fins 27, 47 and displacer fin 35, 55 perpendicular to passageway 36, 56.

This insures that gas 18 entering both the upper and lower parts of the working volume flows across the heat exchanger surface. The cylinder fins 27, 47 are also provided with a thermal control passageway 28, 48 that directs a thermal control fluid through a loop within the cylinder fin to thereby maintain the external surfaces, the heat exchange surfaces, of the cylinder fin 27, 47 at the desired constant temperature. In the particular embodiment shown in FIG. 4, only every other displacer fin 35, 55 is equipped with the working fluid passageway 36, 56 and so, in order to relieve pressure build up that might be caused by the working fluid 15, 16 entering the particular constant temperature area and to distribute the flow, a series of orifices or cut outs 60 are provided through each of cylinder fins 27, 47.

As previously mentioned, further improvements can be made to the cylinder fins and to the displacer fins as may be required to accomodate a particular application or a particular working fluid. The embodiment of FIG. 4, as shown and described, can readily be adjusted to a different application, e.g. to change the amount of friction generated by the working fluid flow along the external surfaces of the displacer fins and the cylinder fins, to reduce the dead volume portion of the working volume by changing the width and/or length of either the cylinder fins or the displacer fins or by changing the gap separating the cylinder fins and the adjacent displacer fins, to change the direction and speed of the working fluid by changing the number of and size of the working fluid passageways through the displacer fins or by changing the exit passageway either in the direction in which it is oriented or in the number of exit passageways per side or the size or location of the exit passageways .

The displacers 32, 52 in the preferred embodiment are also designed to house the regenerator matrix 38, 58. As previously described a Vuilleumier cycle unit requires areas of fixed, constant temperature. When working fluid 15 flows through the displacer 32, 52 from one constant temperature area to another the working fluid 15, 16 needs to move through a regenerator material 38, 58 between the two different temperature areas that is capable of isolating the different temperature areas from each other. In a Vuilluemier cycle there are three separate fixed temperature areas, generally described as the hot volume, i.e. the area between the heated end of cylinder 12 and displacer 52, the cold volume, i.e. the area between the refrigerated end of cylinder 11 and displacer 32, and the cooled volume, i.e. the area between the two displacers 32 and 52. In the embodiment of FIG. 1, therefore, there are two regenerator matrixes as shown. A first or hot regenerator matrix 58 is positioned between the hot volume and the cooled volume and a second or cold regenerator matrix 38 is positioned between the cold volume and the cooled volume. Whenever the working fluid is moved from one constant temperature area to another it passes through one of the regenerator matrices 38, 58. However, to provide a regenerator matrix 38, 58 that perfectly isolates the different constant temperature areas is not always practical. Either the regenerator matrix 38, 58 would be very large to ensure that the working fluid 15, 16 was able to interact with the regenerator elements, 57 for a sufficient time to change its temperature, or it would be very dense to retard the speed of the working fluid and hence ensure sufficient time for the heat transfer. A large matrix makes a Vuilleumier unit impractical while a dense matrix causes undesirable pressure losses. Therefore it is preferrable to assist the less-than-perfect regenerator with a heat transfer means at each interface between adjacent constant temperature areas. Also, since the cylinders of the Vuilleumier unit cannot practically be designed to isolate the several constant temperature areas from the surrounding environment, the heat transfer means also should be capable of maintaining the temperature in a given area. The complementary fins, i.e. the cylinder fins 37, 47 and the displacer fins 35, 55, are provided at the interface between each working volume to allow heat transfer with minimal temperature difference between the working fluid 18 and the heat source or sink, while the circulating external fluid 15, 16, 17 maintains the heat sink or source at a constant temperature. In the embodiment show in FIG. 1 the first interface is between the hot end of the heated cylinder 12 and the working fluid, the second interface is between the ambient ends of cylinder 12 and the working fluid, the third interface is between the cold end of the refrigerated cylinder 11 and the working fluid, and the fourth interface is between the ambient end of cylinder 11 and the working fluid.

The cold regenerator matrix 38 is perhaps the most important component of a Vuilleumier cycle pump used for refrigeration purposes. The regenerator 38 is required to absorb enough of the heat energy in working fluid 18 to cool working fluid 18 as it passes through on its way from the ambient volume of the refrigerated cylinder to the cold volume. After working fluid 18 is further reduced in temperature at the third interface as it expands in the cold volume it is returned to the ambient volume by passing through the cold regenerator 38. In this return flow the working fluid removes the heat previously stored in cold regenerator 38 and lowers the regenerator matrix temperature such that it is capable of cooling working fluid 18 during the next cycle. The working fluid is then returned to the cooled volume temperature at the fourth interface.

To select and design a cold regenerator matrix 38 capable of providing temperature isolation between two different, constant temperature areas, the material of composition of matrix 38 must first have a large heat capacity relative to that of the working fluid 15. The regenerator material 39 must have large values for its heat transfer coefficient, heat transfer area and thermal diffusity as well as be able to limit axial conduction of heat. Unfortunately the more efficient the regenerator is as a temperature isolator the higher the pressure drop that is likely to be experienced. Hence a certain amount of trade-off in design will be required in finalizing an optimum cold regenerator design, and considerable experimentation may be necessary to satisfy the particular requirements of a given application. One material of particular utility as a cold regenerator material is small diameter monel shot. A spherical shape for the material was determined by experimentation to be the preferred shape in order to provide the maximum heat capacity in the regenerator 38. Additional material that were found to be acceptable are Inconel and stainless steel.

The hot regenerator 58 is designed to act as the thermal isolator between the ambient volume in the heated cylinder and the hot volume. As with the cold regenerator 38, the hot regenerator 58 is housed in one of those displacers 52, between two substantially constant temperature zones. As the working fluid 18 is moved from the ambient volume on its way to the hot volume it is heated by hot regenerator element 59 such that when fluid 18 enters the hot volume it is at a temperature approaching the constant temperature of the hot volume cylinder 12. After working fluid 18 is further heated at the first interface to bring it up to the temperature of the hot volume as it expands in the hot volume, fluid 18 is then returned to the ambient volume by passing through hot regenerator 58. In this return flow fluid 18 returns heat to the regenerator elements 59, cooling the working fluid 18 and reestablishing the temperature profile of regenerator matrix 58 for the next cycle.

Generally the heated cylinder 12 and the associated hot regenerator 58 are going to be somewhat larger that the refrigerated cylinder 11 and its associated cold regenerator 38. As a result, any pressure drop across hot regenerator 58 will more greatly effect the performance of the drive motor. Consequently the trade-off between temperature isolation and pressure drop will have more importance with regard to the hot regenerator design. Fortunately, in a refrigeration mode, the Vuilleumier cycle unit can readily make up for any thermal losses due to this trade-off by increasing the heat input on a one-to-one basis with thermal loss. By way of contrast, in the cold regenerator any such thermal losses are magnified by the coefficient of performance of the refrigeration device employed for maintaining the cold volume temperature. Since pressure drops across the hot regenerator have a greater impact on the drive motor, it is important to prevent too great a pressure drop. The preferable material of construction for the hot reginerator therefore is a screening material or wire mesh preferably made from stainless steel since it has reasonably good heat capacity, a good heat transfer coefficient and thermal diffusity, and is able to withstand the conditions of service.

A final design consideration in constructing a Vuilleumier Cycle unit that can employ the modified heat exchanger of the present invention to best advantage is the external insulation that is provided to protect the unit from excessive losses of energy or efficiency. The question of insulation is more particularly related to the proposed use of Vuilleumier cycle units in aircraft and spacecraft. However the design of Vuilleumier cycle units for land based applications should also address the need for and the specific material to be employed for insulation. Specifically, the insulation for the refrigerated cylinder 11 should be capable of limiting the heat transferred from the surrounding environment into the cold volume, and the insulation for the heated cylinder 12 should be capable of limiting the heat transferred from the hot volume to the environment. Some consideration needs to be given to the differing insulating needs for that area encompassing the refrigeration means and the cold volume, and that area encompassing the ambient volume and the cold regenerator. With respect to the heated cylinder, some consideration needs to be given to the differing insulation needs for that area comprising the heating means and the hot volumes, and to that area comprising the ambient volume and the hot regenerator. The specific insulation material employed in a given Vuilleumier cycle until will vary considerably depending upon the particular application and service location. Selection of a suitable material is well within the skill of one of ordinary skill in the art and will not be further specified here.

The final design and material of construction for a particular Vuilleumier cycle engine/refrigerator to be employed in a particular service and location will vary considerably. However in every instance the basis principles for an efficient Vuilleumier cycle unit remain the same and the need for a efficient heat exchanger will not change. The modified heat exchanger of the present invention can therefore provide an advantage over conventional heat exchange means normally employed with Vuilleumier cycle engines/refrigerators. The embodiment described above is only one such embodiment and various improvements, modifications, and alternative applications and uses will be readily apparent to those of ordinary skill in the art. Accordingly, the scope of the present invention should be considered in terms of the following claims and it is not to be limited to the details of the embodiment and its structure and operation, shown and described in the specification and drawings.

I claim:

1. A heat pump comprising:

(a) a pair of chambers and a plurality of elements extending within said chamber elements;

(b) a working fluid disposed in said chambers;

(c) a displacer means positioned in each of said chambers that is movable within said chambers, each of said displacer means having: a wall that divides said respective chambers into a first zone and a second zone, a regenerator material housed therein, a plurality of elements extending outwardly from and in proximity to said elements extending within said respective chamber, and at least one passageway communicating through said displacer means and through said respective regenerator material for said working fluid to flow therethrough between said zones;

(d) drive means suitably supported for reciprocably moving both of said displacer means in their said respective chambers between said respective zones of said chambers;

(e) means for maintaining said first respective zone of each of said chambers at a cool temperature; and (f) means for maintaining said second respective zone of one of said chambers at a temperature that is higher than the temperature of said first respective zone and the second respective zone of said other chamber at a temperature that is lower than the temperature of said first respective zone.

2. The heat pump of claim 1 wherein said displacers are in sealing contact with the inner walls of their respective chambers whereby the zones are sealingly isolated from each other except via the at least one passageway communicating through said displacers and said respective regenerator materials.

3. The heat pump of claim 1 or 2 wherein said chambers are cylindrical and are disposed at a 90° angle relative to each other.

4. The heat pump of claim 3 wherein said elements of each of said cylindrical chambers are extending inwardly from both ends of said chambers and towards each other, and said respective displacer elements are extending outwardly and are arranged in complementary pattern to said chamber elements.

5. The heat pump of claim 1 or 2 wherein some of said displacer elements include a passageway therethrough connecting with said passageway through said regenerator material for said working fluid, and said passageway causes said working fluid to enter and exit from said displacer elements in a direction substantially perpendicular to the surface of said elements.

6. The heat pump of claim 1 or 2 wherein one of said second zones is maintained at a lower temperature by a refrigerant.

7. The heat pump of claim 1 or 2 wherein one of said second zones is maintained at a higher temperature by heating elements.

8. The heat pump of claim 1 or 2 wherein the chamber having its second zone maintained at a lower temperature has a regenerator material having a large heat capacity relative to said working fluid, having a large value for its heat transfer coefficient, heat transfer area and thermal diffusity and being capable of limiting axial conduction of heat.

9. The heat pump of claim 8 wherein the regenerator material is comprised of spherically shaped, small diameter monel shot.

10. The heat pump of claim 8 wherein the regenerator material is comprised of spherically shaped, small diameter inconel.

11. The heat pump of claim 8 wherein the regenerator material is comprised of spherically shaped, small diameter stainless steel shot.

12. The heat pump of claim 1 or 2 wherein the chamber having its second zone maintained at a higher temperature has a regenerator material capable of effecting the heat transfer without a significant pressure drop.

13. The heat pump of claim 12 wherein the regenerator material is comprised of a stainless steel wire mesh material.

14. The heat pump of claim 1 or 2 wherein the first zones of both chambers are maintained at a cool temperature by the same means.

15. The heat pump of claim 1 or 2 wherein the initial power to operate said drive means is powered by an external heat input and a substantial portion of the power for continued operation is derived from the waste heat generated by said heat pump.

16. The heat pump of claim 15 wherein said external heat input is solar energy.

17. A Vuilleumier cycle unit comprising:

(a) a pair of cylinders having two closed ends and each cylinder having one end that is adjacent to an end of said other cylinder, each of said cylinder ends including a plurality of inwardly extending fins;

(b) a working fluid disposed in both of said cylinders;

(c) a displacer element positioned in each of said cylinders that is freely movable within said cylinders, said displacers having circumferential wall that is in sealing contact with the interior walls of said cylinders, a central section for housing a regenerator material, a plurality of fins extending outwardly from both ends of said control section, and having at least one passageway communicating through said central section whereby said working fluid can freely flow between ends of said cylinder;

(d) a drive means suitably supported that is positioned near said adjacent ends of said cylinders and connected to and for alternatingly moving said displacers in said cylinders between said ends of said cylinders;

(e) a means for maintaining the adjacent ends of said cylinders at a constant temperature;

(f) a means for maintaining the other end of one of said cylinders at a constant temperature that is higher than the constant temperature of said adjacent ends; and (g) a means for maintaining the other end of one of said cylinders at a constant temperature that is lower than the constant temperature of said adjacent end.

18. The heat pump of claim 17 wherein said elements of each of said cylindrical chambers are extending inwardly from both ends of said chambers and towards each other, and said respective displacer elements are extending outwardly and are arranged in a complementary pattern to said chamber elements.

19. The heat pump of claim 17 or 18 wherein said chambers are cylindrical and are disposed at a 90° angle relative to each other.

20. The heat pump of claim 19 wherein said elements of each of said cylindrical chambers are extending inwardly from both ends of said chambers and towards each other, and said respective displacer elements are extending outwardly and are arranged in a complementary pattern to said chamber elements.

21. The heat pump of claim 17 or 18 wherein some of said displacer elements include a passageway therethrough connecting with said passageway through said regenerator material for said working fluid, and said passageway causes said working fluid to enter and exit from said displacer elements in a direction substantially perpendicular to the surface of said elements.

22. The heat pump of claim 17 or 18 wherein one of said second zones is maintained at a lower temperature by a refrigerant.

23. The heat pump of claim 17 or 18 wherein one of said second zones is maintained at a higher temperature by heating elements.

24. The heat pump of claim 17 or 18 wherein the chamber having its second zone maintained at a lower temperature has a regenerator material having a large heat capacity relative to said working fluid, having a large value for its heat transfer coefficient, heat transfer area and thermal diffusity and being capable of limiting axial conduction of heat.

25. The heat pump of claim 24 wherein the regenerator material is comprised of spherically shaped, small diameter monel shot.

26. The heat pump of claim 24 wherein the regenerator material is comprised of spherically shaped, small diameter inconel.

27. The heat pump of claim 24 wherein the regenerator material is comprised of spherically shaped, small diameter stainless steel shot.

28. The heat pump of claim 17 or 18 wherein the chamber having its second zone maintained at a higher temperature has a regenerator material capable of effecting the heat transfer without a significant pressure drop.

29. The heat pump of claim 28 wherein the regenerator material is comprised of a stainless steel wire mesh material.

30. The heat pump of claim 17 or 18 wherein the first zones of both chambers are maintained at a cool temperature by the same means.

31. The heat pump of claim 17 or 18 wherein the initial power to operate said drive means is powered by an external heat input and a substantial portion of the power of continued operation is derived from the waste heat generated by said heat pump.

32. The heat pump of claim 31 wherein said external heat input is solar energy.

* * * * *